United States Patent [19]

Tanaka et al.

[11] 3,932,188

[45] Jan. 13, 1976

[54] SILVER HALIDE PHOTOGRAPHIC LIGHTSENSITIVE MATERIAL

[75] Inventors: Akira Tanaka; Kiyoshi Futaki; Bunzo Ueda, all of Nagaokakyo, Japan

[73] Assignee: Mitsubishi Paper Mills, Ltd., Japan

[22] Filed: Feb. 24, 1975

[21] Appl. No.: 552,262

[30] Foreign Application Priority Data

Feb. 25, 1974 Japan ..... 49-21524

[57] ABSTRACT

Irradiation and halation of a silver halide photographic lightsensitive material can be prevented by adding at least one of dyes represented by the following general formula to the layers on one or both sides of the light sensitive material.

(wherein X is hydrogen atom, hydroxyl group, a halogen atom or a lower alkyl group, L is a methine group which may be substituted with a lower alkyl group at mesoposition, M is hydrogen atom, an alkali metal or ammonium group and $n$ is 1 or 2).

[52] U.S. Cl. ..... 96/84 R; 260/240.2

[51] Int. Cl.[2] ..... G03C 1/84

[58] Field of Search ..... 96/84 R; 260/240.2

[56] References Cited

UNITED STATES PATENTS

| | | | |
|---|---|---|---|
| 2,274,782 | 3/1942 | Gaspar | 96/84 R |
| 3,502,474 | 3/1970 | Tsuda et al. | 96/84 R |
| 3,647,460 | 3/1972 | Hofman et al. | 96/66 |
| 3,746,539 | 7/1973 | Ohmatsu et al. | 96/84 R |
| 3,865,817 | 2/1975 | Kobayashi et al. | 260/240.2 |

*Primary Examiner*—Ronald H. Smith

*Attorney, Agent, or Firm*—Cushman, Darby & Cushman

7 Claims, No Drawings

SILVER HALIDE PHOTOGRAPHIC LIGHTSENSITIVE MATERIAL

BACKGROUND OF THE INVENTION

The present invention relates to a silver halide photographic lightsensitive material containing a dye and more particularly it relates to a silver halide photographic light sensitive material prevented from irradiation and halation.

It is well known that dyes which absorb undesired reflected light, scattered light, diffused light in lightsensitive emulsion layer or undesired reflected light from boundary face between the emulsion layer and a support and back face of the support are contained in a silver halide photographic light sensitive material to prevent irradiation and halation, thereby to increase sharpness of the obtained photographic image.

It is natural that the dyes used in the lightsensitive emulsion layer between the lightsensitive emulsion layer and the support or in the back coating of the support for preventing irradiation and halation must not cause fading or discoloration during preparation of solution or must not cause change with lapse of time during preparation of the lightsensitive emulsion and storage. Furthermore, such dyes must not have adverse effect on photographic characteristics such as fog, decreasing of sensitivity, etc. Moreover, they must be completely and rapidly decolorized and removed from photosensitive material during photographic developing process. They must have appropriate spectral absorption characteristic which corresponds to respective object of use and exhibit effect of preventing irradiation and halation.

Considerably a large number of dyes have been proposed, but substantially none of them meet the requirements on photographic characteristics, decolorizability and removability and absorption characteristic.

SUMMARY OF THE INVENTION

The inventors have found that the methine oxonol dyes having the following general formula satisfy the above requirements and have effect of preventing irradiation and halation.

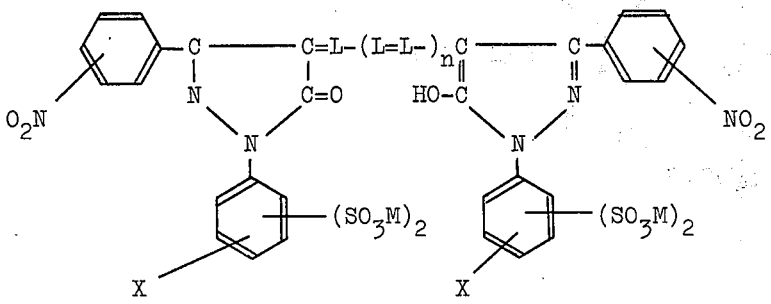

Dye (I)

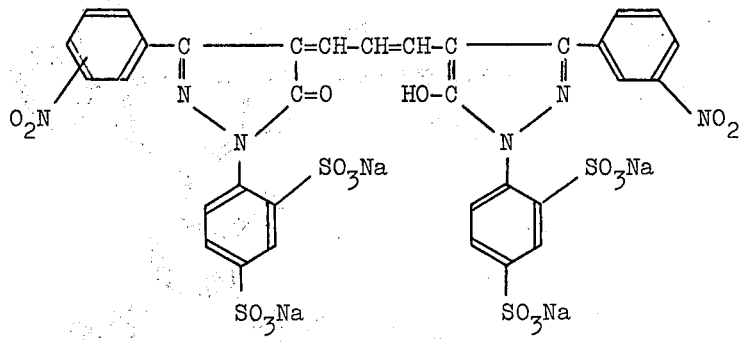

(wherein X represents hydrogen atom, hydroxyl group, a lower alkyl group or a halogen atom; L represents a methine group which may be substituted with lower alkyl group at mesoposition; M represents hydrogen atom, an alkali metal or ammonium group and *n* is 1 or 2).

Silver halide photographic lightsensitive materials colored with the methine oxonol dyes represented by the above general formula possess a wide absorption band in objective absorption wave length region and have substantially no unnecessary absorption in other wave length region. Furthermore, when n is 2 and 3-position of the pyrazolone ring is p-nitrophenol group, the absorption maximum of present pentamethine oxonol dyes shifts to longer wave length side than there which was proposed in Japanese Patent Publication No. 22069/64. So especially, when said pentamethine oxonol dyes of the present invention are used in color lightsensitive materials, they are markedly useful as irradiation preventing dyes for red sensitive emulsion layer including cyan coupler.

The dyes used in the present invention have no adverse effect on photographic characteristics such as fog, decreasing of sensitivity, etc. and in addition, they are completely and rapdily decolorized and dissolved out from lightsensitive materials after developing process to cause no coloration of the photographic image due to residue of the dyes used. Furthermore, the dyes used in the present invention show no fading and discoloration during preparation of dye solution and are not utterly influenced by external conditions such as humid heat during preparation of lightsensitive emulsion and storage.

DETAILED DESCRIPTION OF THE INVENTION

Representative examples of the dyes represented by the above general formula are as follows:

Dye (II)
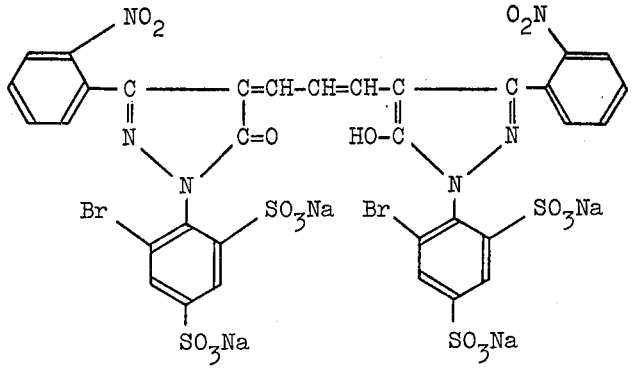
Dye (III)
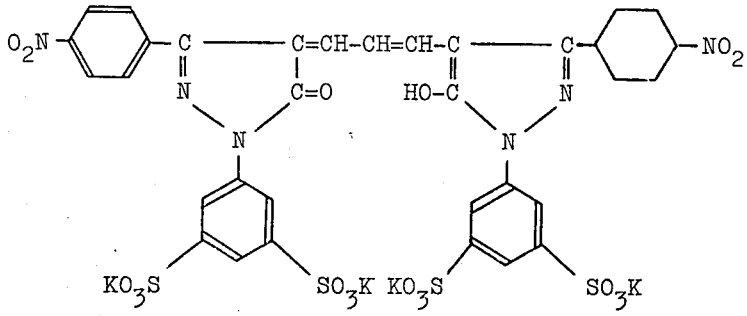
Dye (IV)
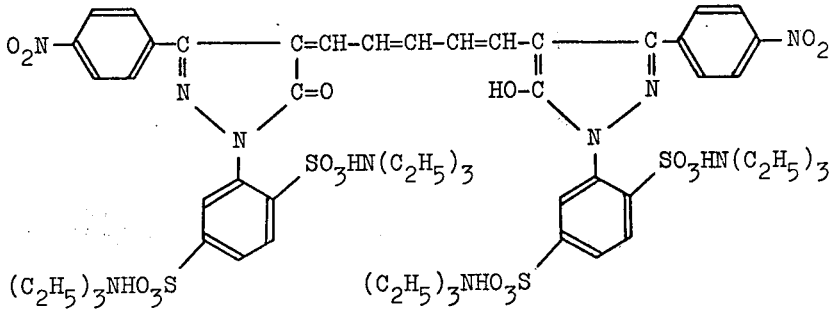
Dye (V)
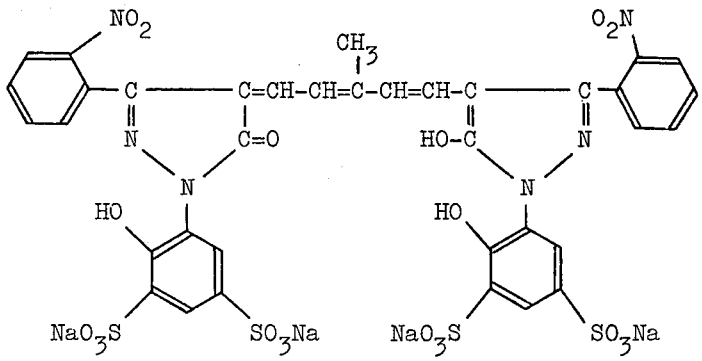

Dye (VI)

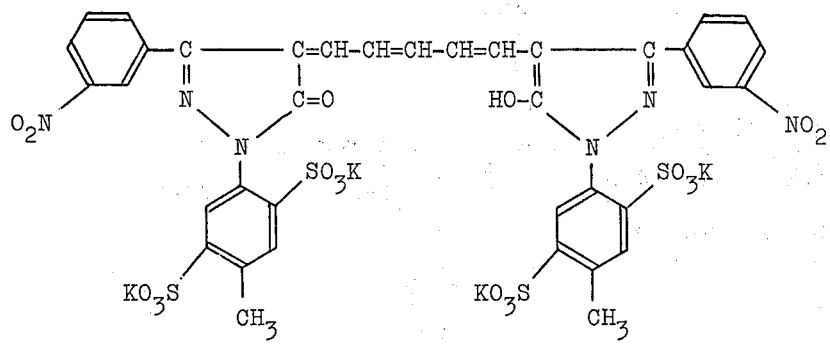

Dye (VII)

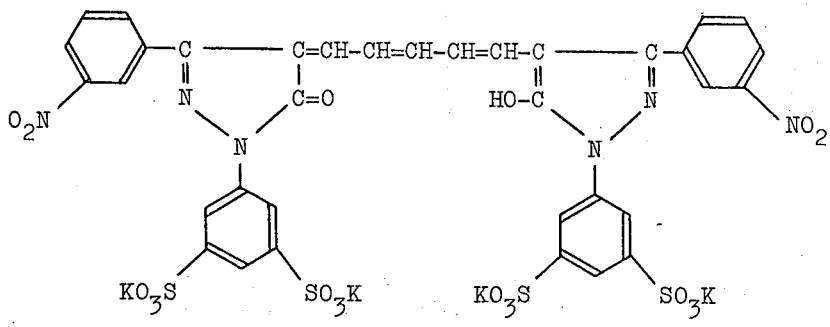

The methine oxonol dyes used in the present invention are not limited to the above exemplified dyes, but any dyes having the chemical structure represented by the general formula may be used. If necessary, they may be used in admixture of two or more.

A method for synthesizing the dye (IV) will be explained below.

1. 2.37 g of ethyl-p-nitrobenzoylacetate (disclosed in H. F. Ginsberg et al "Journal of the American Chemical Society" Vol. 75, Page 4587, 1953) and 2.68 g of phenylhydrazine-2,5-disulfonic acid in 60 ml of 50% acetic acid are heated at 95°–100°C for 8 hours. Then, the solvent is concentrated under reduced pressure and ethanol was added to the residue, then the solid was collected on a Büchner funnel and dried to obtain 3.01 g of a light yellow solid having a melting point above 300°C.

2. 1.94 g of above obtained 3-(4-nitrophenyl)-1-(2,5-disulfophenyl)-5-pyrazolone and 0.57 g of glutacondialdehydedianil hydrochloride are suspended in 40 ml of methanol, to which 1.61 g of triethylamine is added and refluxed for 30 minutes. The dye solution obtained is concentrated under reduced pressure. Then, 40 ml of ethanol is added and refluxed for 5 minutes. The dye separated upon warming is collected on a Büchner funnel. Said ethanol washing is repeated further 2 times and then the dye is dried to obtain 0.86 g of dark blue dye (IV) having a melting point above 300°C. Absorption maximum of an aqueous solution of the dye is 640 mμ.

Other dyes having three methine chains [e.g., dyes (I), (II) and (III)] may also be synthesized in the same manner as above except malondialdehydedianil hydrochloride is substituted for glutacon dialdehydedianil hydrochloride.

Thus obtained dyes having the general formula as given above are added preferably in the form of an aqueous solution to silver halide emulsion or protective colloid solution.

Amount of the dye used in the present invention is preferably about 1 mg — about 10 g/m². When the amount is less than about 1 mg/m², effect of preventing irradiation is extremely small and when the amount is more than about 10 g/m², unfavorable reduction in photographic sensitivity is caused and moreover elimination of the dye by photographic treatments cannot be completely attained.

The dyes used in the present invention have effects of preventing irradiation and halation. When prevention of irradiation is desired, the dye is preferably added in an amount of about 1 mg — about 100 mg/m² to at least one layers of the silver halide emulsion layer, the intermediate layer and the overcoating layer. When prevention of halation is aimed at, the dye is preferably added in an amount of about 10 mg — about 10 g/m² to at least one layers of undercoating layer and back-coating layer of the suppert.

The following working examples illustrate formation of an irradiation preventing layer and a halation preventing layer with use of the dyes according to the present invention.

EXAMPLE 1

The following layers were succesively coated on a photographic support on which polyethylene was laminated to obtain a multilayer color photographic paper (Sample No. 1).

1. A blue sensitive silver iodochlorobromide emulsion layer (silver bromide . . . about 98 mol %) containing a yellow coupler having the following formula:

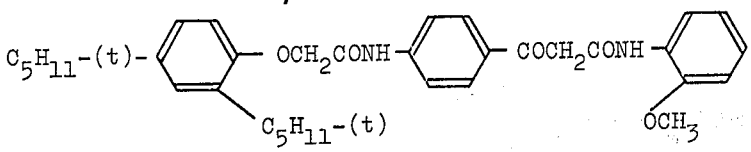

Said emulsion layer additionally contained the usual stabilizer, hardener, wetting agent for coating, etc.

2. An intermediate layer comprising 4% aqueous solution of gelatin.

3. A green sensitive silver chlorobromide emulsion layer (silver bromide . . . about 35 mol %) containing the following magenta coupler.

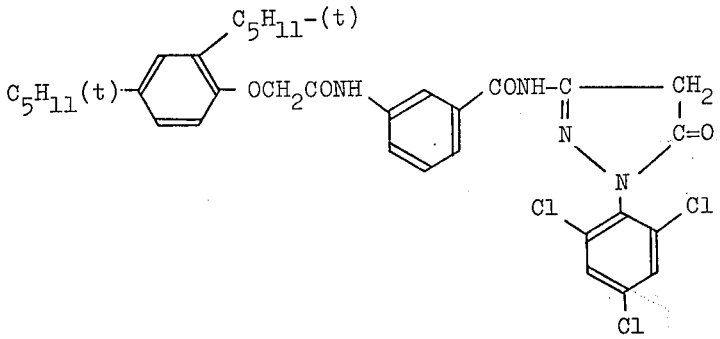

4. An intermediate layer comprising 4% aqueous solution of gelatin.

5. A red sensitive silver chlorobromide emulsion layer (silver bromide . . . about 35 mol %) containing the following cyan coupler.

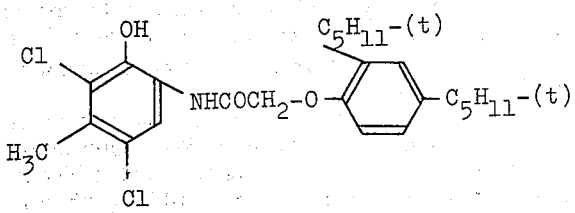

6. A protective layer having the same compositions as the layers (2) and (4).

Sample No. 2 was prepared in the same manner as of preparation of the Sample No. 1 except that 50 ml of 2% aqueous solution of the dye (IV) enumerated hereinbefore was added to 1 kg of the red sensitive silver chlorobromide emulsion used in preparation of the sample No. 1.

In the same manner as mentioned above, sample No. 3 having 50 ml of 2% aqueous solution of the following known dye A was prepared.

Dye A

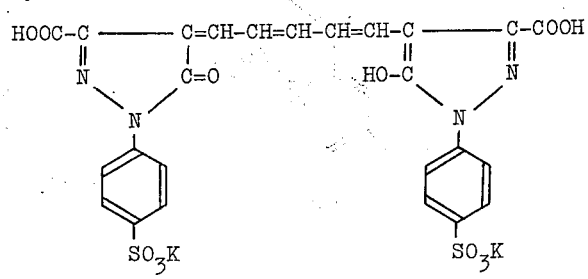

These samples were exposed and then treated with the following processing solutions.

| | |
|---|---|
| Color developing solution (abbreviated as CD). | |
| Benzyl alcohol | 15 ml |
| KBr | 0.3 g |
| Sodium hexametaphosphate | 0.5 g |
| Sodium sulfite | 2.0 g |
| Hydroxylamine hydrochloride | 2.0 g |
| Sodium carbonate (monohydrate) | 28.0 g |
| CD-3* | 4.8 g |
| Water to make 1000 ml | |
| *Trade name for color developer produced by Estman Kodak Co. | |
| Bleaching and fixing solution (abbrivated as BF) | |
| EDTA iron salt | 62 g |
| EDTA-2-sodium salt | 3 g |
| Ammonium thiosulfate | 75 g |
| Sodium sulfite | 10 g |
| Sodium carbonate (monohydrate) | 5 g |
| Water to make 1000 ml | |
| Stabilizing solution (abbrivated as SB) | |
| 45% acetic acid | 19 ml |
| Sodium acetate | 3 g |
| Water to make 1000 ml | |

All processings were conducted at a high temperature and a high speed in accordance with the conditions enumerated in the following table.

| | Temperature | Processing time |
|---|---|---|
| CD | 33°C | 3 minutes and 30 seconds |
| BF | " | 1 minute and 30 seconds |
| Washing with water | " | 2 minutes |
| SB | " | 30 seconds |
| Washing with water | " | 15 seconds |
| Total | | 7 minutes and 45 seconds |

Density of unexposed areas of each sample after subjected to the above process was measured. The results are shown in the following table.

| Sample | Dye | Density of unexposed area Blue density | Green density | Red density |
|---|---|---|---|---|
| 1 | None | 0.04 | 0.04 | 0.02 |
| 2 | The present dye | 0.04 | 0.04 | 0.02 |
| 3 | The known dye A | 0.05 | 0.05 | 0.07 |

As is clear from the above table, in the case of the sample containing the present dye, decolorization rapidly took place. Moreover, the sample containing the present dye had no color stain as in the sample containing the known dye. Furthermore, response functions of these samples were obtained using square wave chart. As the result, it was found that the Sample No. 2 was extremely excellent than the Sample No. 1 and showed higher sharpness than the Sample No. 3.

Spectral reflection characteristic of the samples No. 2 and 3 was measured to obtain the following results.

| Sample | Dye | Spectral reflection maximum |
|---|---|---|
| 2 | The present dye | 665 mμ |
| 3 | The known dye A | 660 mμ |

EXAMPLE 2

To 1 kg of the same green sensitive silver chlorobromide emulsion as used in a layer (3) of Sample No. 1 in Example 1 was added 25 ml of 2% aqueous solution of the dye (III) of the present invention as enumerated hereinbefore. In the same manner, another emulsion was prepared using the following known dye B in place of the dye (III).

Dye B

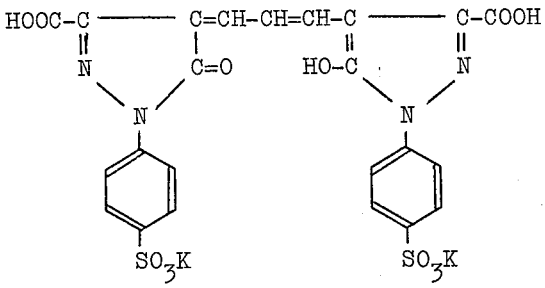

Using these emulsions, multilayer color photographic papers of samples No. 4 and 5 were produced in the same manner as production of Sample No. 1 in Example 1. That is, other layers were the same as those of Sample No. 1.

Samples No. 1, 4 and 5 were exposed and then subjected to the same processes as in Example 1. Thereafter, density of unexposed areas of these samples was measured. As shown in the following table, the sample containing the present dye was rapidly decolorized and showed no color stain.

| Sample | Dye | Density of unexposed area Blue density | Green density | Red density |
|---|---|---|---|---|
| 1 | None | 0.04 | 0.04 | 0.02 |
| 4 | The present dye | 0.04 | 0.04 | 0.02 |
| 5 | The known dye B | 0.05 | 0.07 | 0.02 |

Response functions of these samples were obtained using square wave chart to find that Sample No. 4 was extremely excellent than Sample No. 1 and showed substantially the same resolving power as Sample No. 5.

EXAMPLE 3

1 g of dye (II) of the present invention and 1 g of dye (VI) of the present invention were added to 1 l of 10% gelatin solution. To the mixture were further added 25 ml of 2% aqueous solution of chrome alum as a hardener and 20 ml of 5% aqueous solution of saponin. The resultant mixture was coated on a surface of a film which was opposite to the surface coated with a silver halide emulsion. This layer was excellent in the effect of preventing halation and was rapidly decolorized and dissolved out during developing process to cause no color stain caused due to remaining dye after process. Moreover, no decreasing of sensitivity and fog were caused during coating of the emulsion and storage of the film. Thus, it was found that this film having such unti-halation layer was an extremely excellent light-sensitive photographic material.

The density in the Examples was measured by Macbeth 514 densitometer.

What is claimed is:

1. A silver halide photographic lightsensitive material having on one or both sides of a support a layer containing at least one of dyes represented by the general formula:

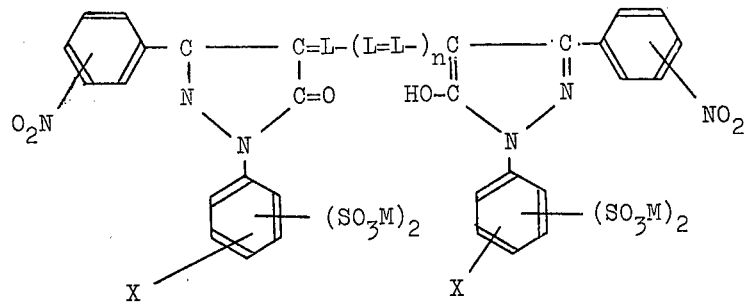

(wherein X is selected from the group consisting of hydrogen atom, hydroxyl group, halogen atom and lower alkyl group; L is methine group which may be substituted with lower alkyl group at meso-position; M is selected from the group consisting of hydrogen atom, alkali metal and ammonium group; and *n* is 1 or 2).

2. A silver halide photographic lightsensitive material according to claim 1, which contains the dye in at least one of silver halide emulsion layer, intermediate layer and over-coating layer.

3. A silver halide photographic lightsensitive material according to claim 1, which contains the dye in at least one of under-coating layer and back-coating layer of the support.

4. A silver halide photographic lightsensitive material according to claim 1, which contains the dye in an amount of about 1 mg — about 10 g/m$^2$.

5. A silver halide photographic lightsensitive material according to claim 2, which contains the dye in an amount of about 1 mg — about 100 mg/m$^2$.

6. A silver halide photographic lightsensitive material according to claim 3, which contains the dye in an amount of about 10 mg — about 10 g/m$^2$.

7. A silver halide photographic lightsensitive material according to claim 1, wherein the dye has the following general formula:

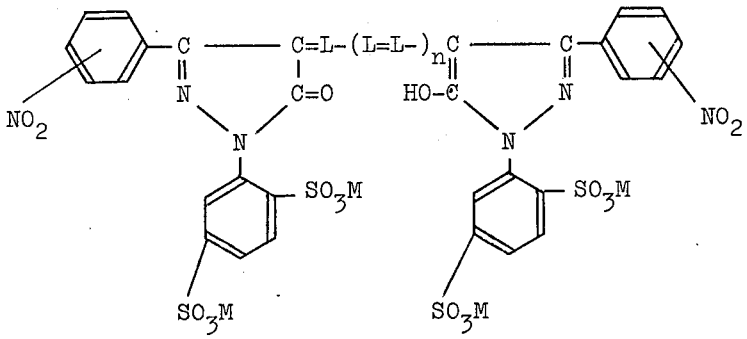

(wherein L, M and n are as defined above).

* * * * *